United States Patent [19]

DiStefano et al.

[11] Patent Number: 5,000,890

[45] Date of Patent: Mar. 19, 1991

[54] METHOD FOR RESETTING SEPARATED TILES

[76] Inventors: Arthur W. DiStefano, 800 E. Camino Real, Apt. 103, Boca Raton, Fla. 33432; Thomas S. Orrell, 121 Wallace Ave., Auburn, Mass. 01501

[21] Appl. No.: 247,398

[22] Filed: Sep. 21, 1988

[51] Int. Cl.[5] ..... B32B 35/00; E02D 37/00; E04B 1/16; E04G 23/02

[52] U.S. Cl. ..... 264/35; 52/514; 52/744; 156/94; 264/36; 264/40.1; 427/140; 428/63

[58] Field of Search ..... 264/31-35, 264/36, DIG. 31, DIG. 57, 40.1; 427/140; 156/94; 428/63; 29/402.18; 52/744, 514

[56] References Cited

U.S. PATENT DOCUMENTS

| | | | |
|---|---|---|---|
| 1,592,591 | 7/1926 | Amele | 264/36 |
| 2,417,026 | 3/1947 | Walter | 52/514 |
| 3,224,346 | 12/1965 | Simonson et al. | 264/31 |
| 3,646,720 | 3/1972 | Watts | 52/744 |
| 4,208,456 | 6/1980 | Holmes | 264/36 X |
| 4,240,995 | 12/1980 | Milne | 264/35 X |
| 4,470,719 | 9/1984 | Dziark et al. | 52/514 X |
| 4,555,286 | 11/1985 | Orikasa et al. | 264/36 X |
| 4,780,162 | 10/1988 | Forler et al. | 264/36 X |

FOREIGN PATENT DOCUMENTS

| | | | |
|---|---|---|---|
| 2854667 | 6/1980 | Fed. Rep. of Germany | 52/514 |
| 0001976 | 1/1978 | Japan | 52/514 |

*Primary Examiner*—Jan H. Silbaugh
*Assistant Examiner*—Karen D. Kutach
*Attorney, Agent, or Firm*—Jack N. McCarthy

[57] ABSTRACT

A method of resetting a separated portion of a tile floor from a base flooring, such as a concrete slab, by drilling a hole through the tile floor into the slab, forcing an adhesive into the hole and separated portion, monitoring the flow controlling upward force on the tiles and controlling the leveling of the titles and resetting.

8 Claims, 5 Drawing Sheets

FIG. 2
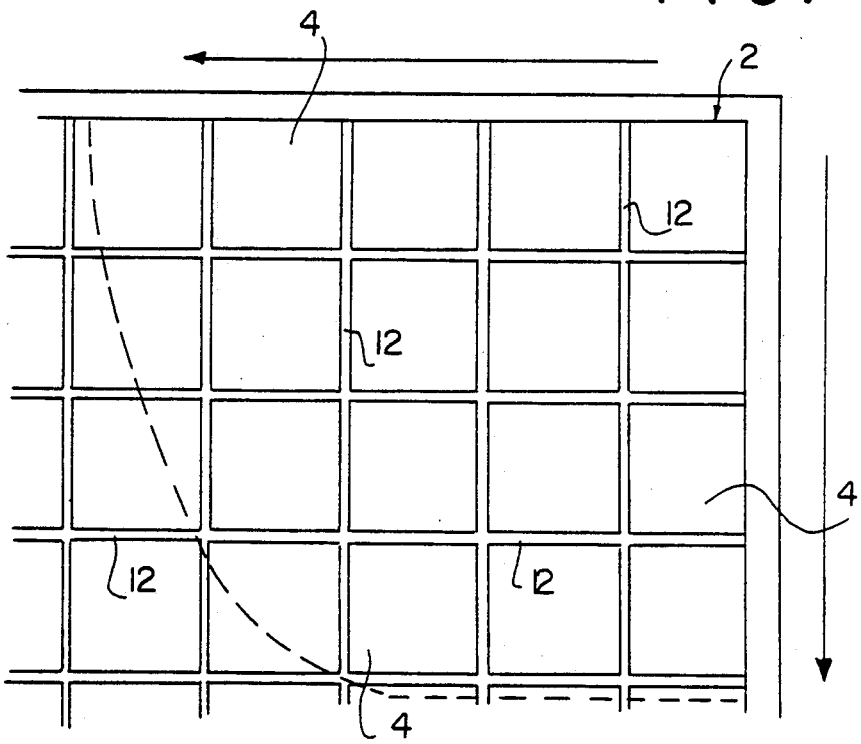
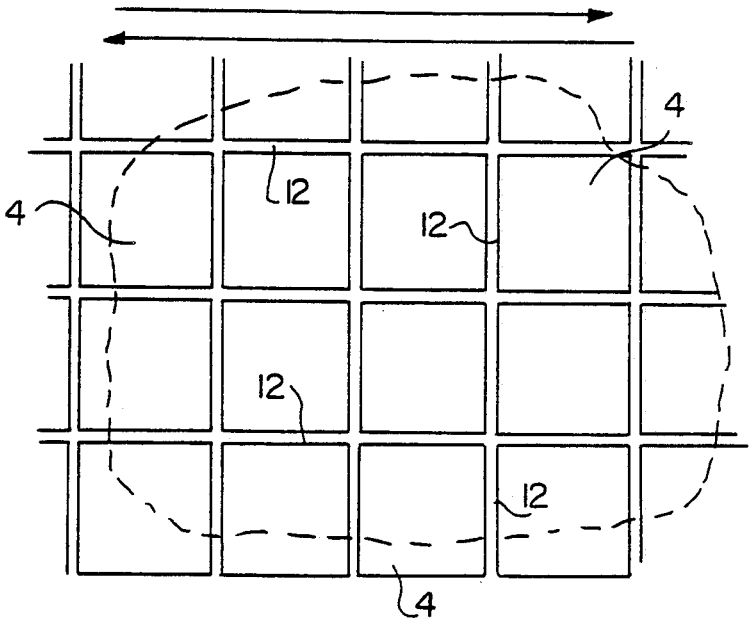
FIG. 3

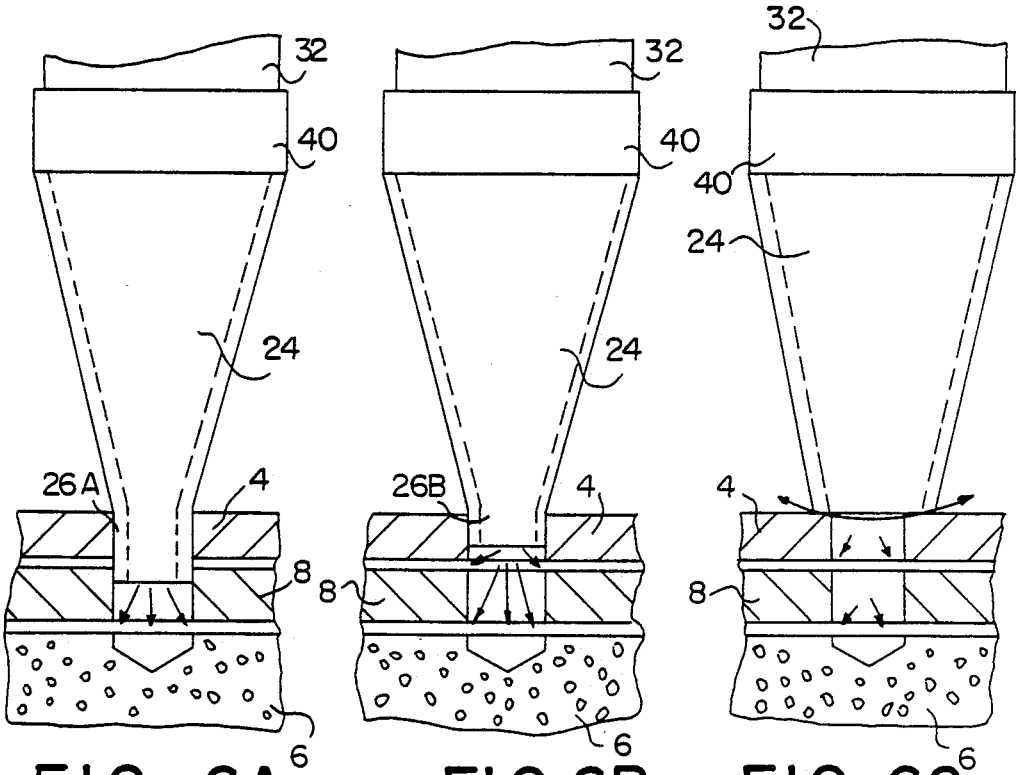
FIG. 6A FIG. 6B FIG. 6C
FIG. 7
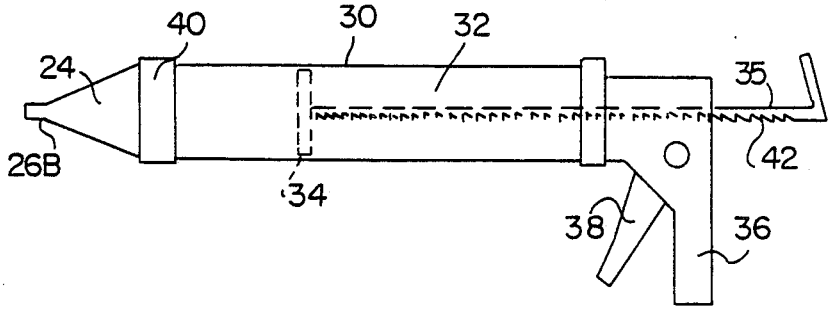

METHOD FOR RESETTING SEPARATED TILES

DESCRIPTION

1. Technical Field

This invention relates to the process of resetting floor tiles and especially for resetting ceramic floor tiles which have become separated from a base supporting surface, such as a concrete slab.

2. Background Art

Repair of tiles separated from a base supporting surface, such as a concrete slab, at present is made by cutting the grouting and lifting the tiles up, cleaning them and resetting them. Where tiles are broken, they are replaced with matching tiles. The complication begins when there are few or no matching replacement tiles. Then to achieve acceptable flooring, whole floors have to be replaced, at a high cost and extreme disruptiveness to the home owner. The non-separated areas usually have to be hammered out. Separated tiles are caused by different reasons, but in the past, it was usually from poor preparation and installation; namely, not cleaning the concrete slab, or using too much set time for the thin-set (thin-set is a thin layer of a mortar which is used to adhere the tile to the already cured concrete). Separation of tiles can occur between the tile and the layer of thin-set or between the thin-set and the base concrete slab. Additional stress, such as a crack from settling, for example, or different expansion rates, may cause large areas to become separated, and in time, perhaps the whole floor. Patents uncovered in the prior art were U.S. Pat. Nos. 1,915,032; 3,194,853; 3,646,720; 4,060,953; 4,214,416; and German Patent Nos. 23 63 032; and 32 09 160.

DISCLOSURE OF INVENTION

An object of this invention is to provide a method of resetting a separated portion of a tile floor without causing extreme disruption of the area.

Another object of this invention is to provide a method of resetting a separated portion of a tile floor including one or more of the following steps:

(1) determining the location of a separated area under the tile floor;

(2) selecting a starting point in the separated area and drilling an injector hole in the grout between adjacent tiles to the separated area;

(3) removing loose material from said separated area;

(4) clearing the tiles around the injector hole to loosen and dislodge any particles and force them out of the separated area;

(5) drilling a venting hole or holes in the grout radially spaced from said injector hole to monitor flow of adhesive injected into said injector hole (a check by sight);

(6) injecting an adhesive into said injector hole to flow into said separated area;

(7) checking the flow of adhesive in said separated area radially from said injector hole by tapping around said hole to detect flow pattern, including blockages and irregular flow (a check by sound);

(8) checking pressure of adhesive in an upward direction on said tiles to prevent excessive lifting of the tiles ( a check by feel);

(9) changing viscosity of adhesive to provide desired flow;

(10) injecting an adhesive into another injector hole (injector hole can be drilled or an old venting hole used if it is properly located) when a radial adhesive flow limit has been reached;

(11) repeating the above steps until a desired separated area has been filled;

(12) cleaning any adhesive which has gotten onto tiles from said vent holes or injector holes;

(13) placing weights on said tile floor to level the floor and keep the separated area together until the tiles are adhered; and

(14) regrouting to provide a smooth, new appearance.

A further object of this invention is to provide an adhesive having the proper viscosity to flow into a separated area. Control of viscosity can control applied pressure on said adhesive to force it to flow properly.

Another object of this invention is to clear an injector hole and adjacent separated area for injection of an adhesive for flow into said separated area by impacting the tiles around the injector hole to loosen and dislodge any particles and force them out of the separated area. To reduce breaking of tiles, a rubber mallet has been used.

A further object of this invention is to check the flow of adhesive radially from an injector hole by sound and/or sight. After the flow pattern has been determined by sound, tapping of the tiles, a hole can be drilled where radial flow has stopped to visually check flow. Usually, additional adhesive injected at this new hole overcomes the blockage. If the separated area has become a very narrow passage, slowing flow of adhesive and putting an upward force on tiles, the viscosity of the adhesive can be changed to increase desired flow.

Another object of this invention is to provide a method of tile floor repair for a large separated area which can be done by completely adhering a desired portion of said separated area, then later continuing the repair to completely adhere a remaining separated area.

BRIEF DESCRIPTION OF DRAWINGS

FIG. 2 is a diagrammatic plan view of a section of a tiled floor having a separated tile area at the corner of a room showing a direction of adhesive flow from the corner out;

FIG. 3 is a diagrammatic plan view of a section of a tiled floor having a separated tile area at the center of the room away from a wall showing two directions of adhesive flow, from one end to the other;

FIG. 6A shows the tip of the nozzle of an adhesive gun in an injector hole for applying adhesive under pressure where the tip of the nozzle extends past the separation between the tile and the thin-set which indicates the nozzle has been inserted too far;

FIG. 6B shows the tip of the nozzle of an adhesive gun in an injector hole for applying adhesive under pressure where the tip of the nozzle extends to a midpoint in the tiles, allowing the adhesive to flow to the area between the tiles and the thin-set and slab, or base;

FIG. 6C shows the tip of the nozzle of an adhesive gun for applying adhesive under pressure where the tip of the nozzle is too large and does not extend into the injector hole, thus permitting the escape of adhesive over the tiles and a lack of the proper pressure to force the adhesive to the proper areas between the tile and thin-set, and thin-set and slab; and FIG. 7 shows an adhesive gun, with a nozzle tip as shown in FIG. 6B, where the force required to make the adhesive flow can be sensed by an operator's hand in squeezing the movable trigger towards the fixed handle.

BEST MODE FOR CARRYING OUT THE INVENTION

Figure 1:
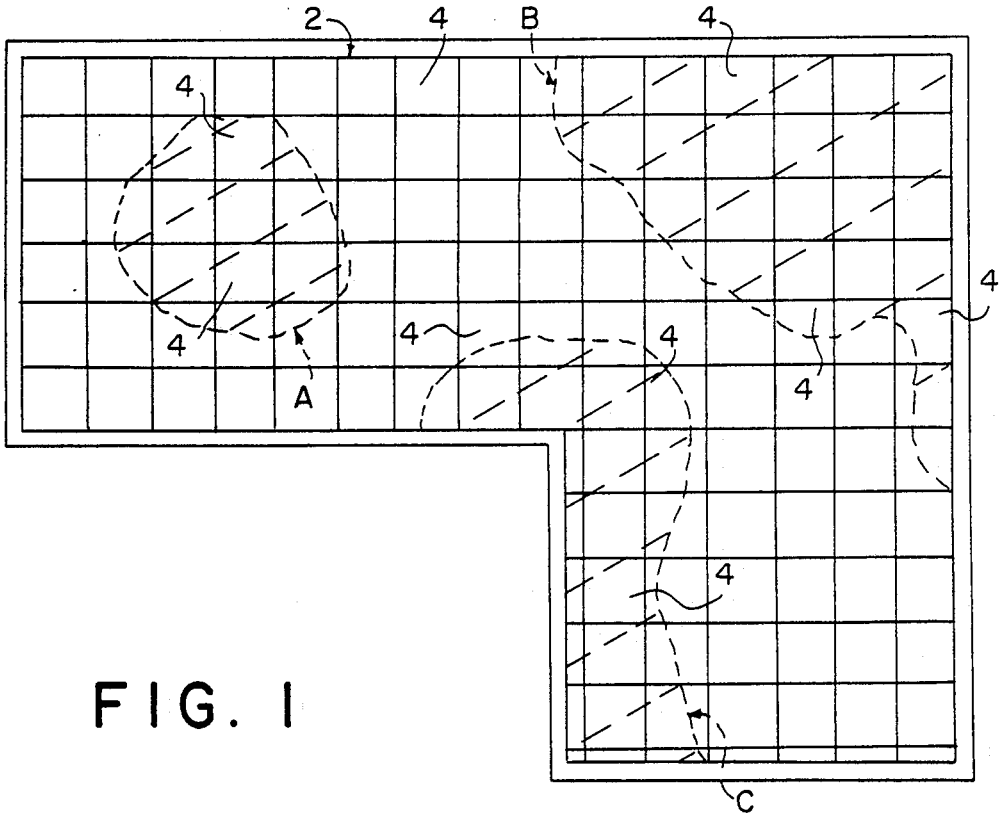
FIG. 1 is a diagrammatic plan view of a tiled floor of a room having areas of tiles separated from the fixed base member, or slab, made by one evaluating the amount of separation.

Referring to FIG. 1 of the drawings, a plan view of a tile floor 2 is shown as having three areas A, B, and C of tiles 4 separated from a fixed base member, or slab, 6. It can be seen that a separated area can occur anywhere in a tiled floor (1) against a flat side, (2) extending outwardly from a corner, and (3) located in the center of a floor not extending to any side. Further, the separated area can cover a few tiles to a large number of tiles. It is also noted that the separation can be between the tile 4 and adhesive, or thin-set, 8 at 14 or between the adhesive, or thin-set 8, and the base surface, or slab, 6 at 16. It is even possible for both separation locations 14 and 16 to occur. A separated area is usually found by a homeowner detecting the different, louder, hollow sound from a shoe or object against the separated tiles.

To repair a separated area, a repairer would first determine the location of a separated area under the tile floor, determining the extent and size of the separated area. This is done by tapping the tiles on the floor with a solid object having a small contact surface, finding the outline of the separated area by sound. This can be done standing up by the use of a long (4-foot) hard wood pole with a small contact diameter. While tapping, the outline of the separated area can be marked by chalk or other removable material; this helps in determining the starting point. The repairer would then select a starting point in the separated area and drill an injector hole 10 in the grout line 12 between adjacent tiles. This hole 10 generally extends the width of the grout between the tiles. The injector hole 10 would be drilled through the grout line 12 and adhesive 8, into the base floor, or slab, 6, so any separated area would be intersected by the hole 10. The repairer would then remove the loose material from the injector hole 10 caused by the drilling. This can be done by vacuuming over the injector hole 10.

The repairer would then force other particles from the separated area adjacent the injector hole 10 such as those pushed, or forced, there by the drilling of the injector hole 10 and possibly particles formed by the separation. In drilling, particles can be pushed in a separated area and not fall loosely into the injector hole 10. This forcing is done by tapping around the injector hole 10 with a rubber mallet, or hammer, being careful not to break a tile. This tapping, or hammering, (1) vibrates, or shakes loose, particles which are in a separated area (said particles resulting from the separation of layers or from the drilling) and (2) forces, or blows out, the loosened particles, or debris, into the injector hole 10 where they can be removed. This allows access to the separated area from the injector hole 10.

Figure 4:
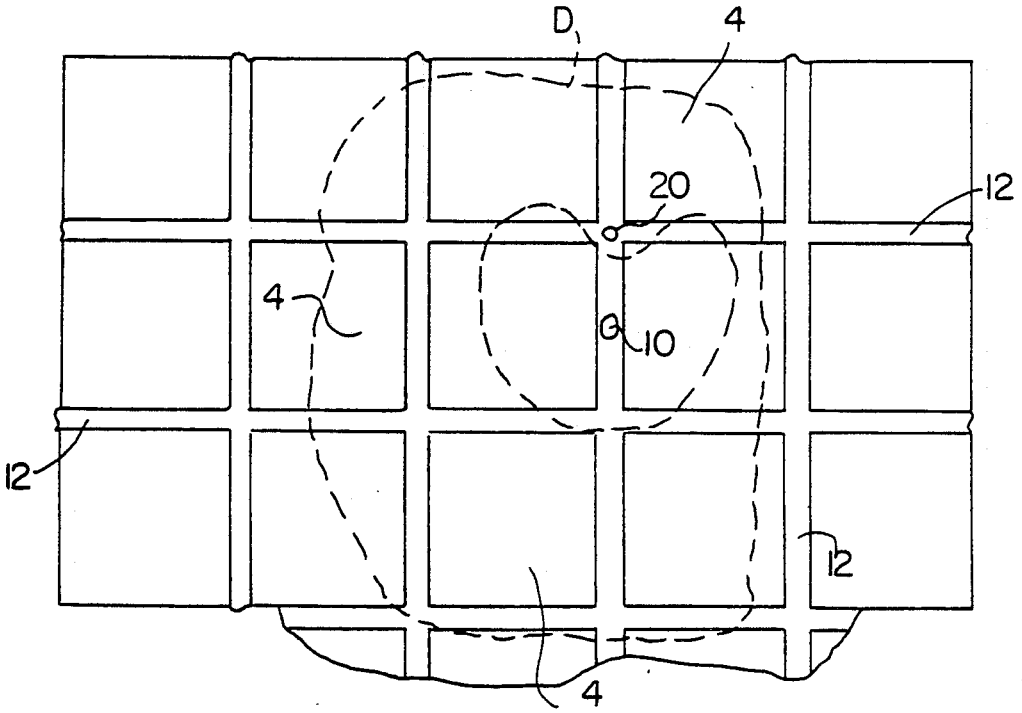
FIG. 4 is a plan view of a small section where a central injector hole is placed to obtain a desired flow of adhesive from the center of a separated area to the outer edge, a venting and injector hole being placed in separated tile area where a blockage occurs.
Figure 5:
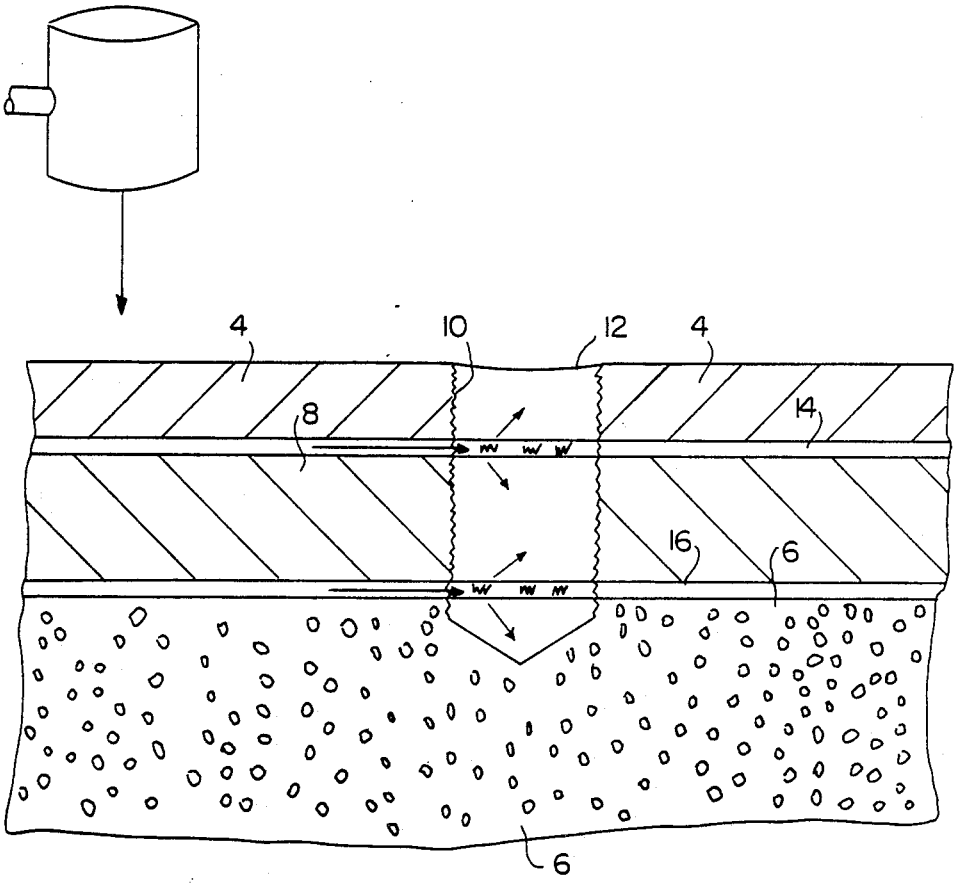
FIG. 5 is an enlarged fragmentary sectional view showing a drilled hole in a grout line between two tiles and extending through the thin-set and into the floor slab, or base, after vacuuming of loose debris, with a portion of a rubber mallet shown for striking the tiles to aid in cleaning the separated area of lodged or stuck debris mostly caused by drilling.

If the area being repaired is a small area, such as shown in FIG. 4, the injector hole 10 could have been placed near the center of the area. Then an adhesive is injected into the injector hole 10 by a manually operated refillable caulking gun 30, of a well known type used in the building industry, to have it enter a separated area and flow radially therefrom in an attempt to fill any separated area. The caulking gun 30 shown has a cylindrical body 32 with a cylindrical chamber for receiving the adhesive; a piston 34 is located in said cylindrical chamber with an actuating rod 35 extending through the closed rear of the cylindrical body 32 to an operating handle 36 and trigger 38. A nozzle 24 has an integral cylindrical element 40 removably connected over the open front of the cylindrical body 32. The cooperating parts of the nozzle 24 and cylindrical body 32 can be threaded together or removably fixed by any well known method.

The piston 34 and actuation rod 35 is moved towards the nozzle 24 by a mechanism mounted within handle 36 and actuated by manually operated trigger 38. The rod 35 has serrations 42 along the length of the bottom thereof so that a pull of the trigger 38, from its position shown in FIG. 7 to a position against handle 36, will engage a flat side of a serration 42 and move the actuation rod 35 and piston 34 a small distance forward and the flat side of a serration 42 will hold the rod 35 and piston 34 in their new advanced position by a stop member biased into the serrations 42; a tapered side of the serrations 42 permits the trigger to be reset to its position in FIG. 7 to be ready to move the rod 35 and piston 34 in another small forward movement. This actuation can be continued until the piston 34 has forced all of the adhesive from the cylindrical chamber through the nozzle 24. Other manually operated devices can be used to inject adhesive as long as the force required to inject the adhesive is sensed by the operator's hand. A resistance to adhesive flow must be capable of being detected by the operator's manual actuation.

The nozzle 24 has a slender plastic tip which is formed appropriately for the injector hole 10. FIGS. 6A, 6B, and 6C show different sizes of plastic nozzles 24. FIG. 6A shows a plastic tip 26A which is too long and would extend into an injector hole 10 below the location where a separation could occur. FIG. 6B shows a plastic tip 26B which is permitted to extend only partially through the thickness of the tile, therefore being able to distribute an adhesive to either of the two locations where a separation could occur. FIG. 6C shows a nozzle with no plastic tip and it can be seen that this construction would permit the escape of adhesive over the tiles and not provide a proper pressure to force the adhesive properly into any separated area.

An adhesive is injected into said injector hole 10, the flow of adhesive is checked radially from said injector hole to detect flow pattern, especially looking for blockages and irregular flow. The checking can be done by taking soundings around the injector hole 10 by using, for example, a wooden dowel or handle to tap said tiles 4. The distinct sounds made by tapping tiles over an open separation and tiles over a separation containing the adhesive, are obvious sounds to detect. Usually the flow is not allowed to continue for more than one or two tiles 4 to prevent a buildup of pressure which would tend to lift adjacent tiles, thereby increasing the separation area and possibly breaking grout lines. It would be entirely possible, having a separated area such as shown in FIG. 4, to completely fill the separated area D through one injector hole 10. However, if there was a blockage indicated in the flow of adhesive in one or more directions (see dot-dash lines in FIG. 4), a venting hole 20 could be drilled at that point to positively check a flow of adhesive in that direction. The adhesive could then be injected into the venting hole 20 as an injector hole 10 to see if the small area could then be filled. If when checking this flow other blockages occur, then other venting holes 20 can be made to check the blockage and then be used as an injector hole 10. This is repeated until the separated area is filled with adhesive. If a blockage occurs because of the narrow separation opening, it may be necessary to adjust the viscosity of the adhesive to obtain more of a liquid flow. This step is hereinafter discussed.

As the separated area D is being filled, there may be times that back flow will occur through a drilled injector hole 10 or venting hole 20, forcing the adhesive onto the top of the tiles. These holes are then closed with a small plug which can be pressed into the hole. These plugs are removed when the separated area has been properly filled.

After a desired separated area has been filled, any adhesive which has gotten onto the tiles, whether from being inadvertently dropped thereon or through venting holes 20 or injector holes 10, can be removed therefrom. The level of the tiles 4 is then checked and, if necessary, weights are placed on said tile floor to maintain the floor level and keep the separated area together until the tiles have adhered to the base flooring, or slab, 6.

One method of checking the level of tiles is to apply a slight pressure on a tile around a drilled opening to determine if a backflow of adhesive occurs through the opening. The amount of flow will determine the distance that the tiles are raised from the base flooring, or slab. Any large amount of backflow is a definite indication of the need for a weight at that location. The backflow of adhesive should be cleaned from the tiles before a weight is placed thereon. After the weights have been placed on the floor, an inspection should be made to see if a backflow continues at any of the openings; such a backflow indicates that a heavier weight is probably necessary in that area. It indicates that the level should be checked again at that point. After the floor is allowed to set, generally undisturbed for one or two days, the grouted joints are scraped, vacuumed, and regrouted. An acid wash may be necessary to blend old grout with new grout.

While the adhesives used during resetting of tiles in the manner just referred to have been standard materials used with tile setting, the viscosity of the adhesive was adjusted to provide satisfactory flow without creating an upward vertical force to lift adjacent tiles 4. Viscosities of adhesives were checked to arrive at a desired flow for spacings obtained in the separation of tiles 4 from a base flooring, or slab, 6. One viscosity is used for average vertical spacings and a decreased viscosity is used for tight, or narrowly separated, vertical spacings. Using a standard viscosity cup, i.e., 100 ml with a 4 mm I.D. drain hole, it was found that an adhesive having a time to drain of approximately 80 seconds was satisfactory for use with the average spacing occurring in separated areas; while the time to drain for an adhesive to use for tight spacings ranged between 30 seconds and 45 seconds. In some installations made, a known latex admixture (LA) was mixed along with a poly-vinyl acetate emulsion (PVAE). For an adhesive mixture for separated areas of average spacings, a mixture of the PVAE to the LA was made 6 parts to 1; and for tight spacings, a ratio of from 2 to 3 parts of the PVAE to 1 part of the LA was used. These mixtures provided an appropriately flowing adhesive for the majority of separated tile floors encountered, without risking undue lifting of adjacent tiles during the resetting operation. If a separated tile floor is encountered with a very small vertical space in the separation which resists adhesive flow being used, the adhesive will need to have its viscosity adjusted to obtain more of a liquid flow.

We claim:

1. A method for repairing a portion of a grouted tile floor where tiles have become separated from a base flooring:

(1) determining a separated area of said tiles;
(2) drilling an injector hole on a grouted joint between said tiles of said separated area into said base flooring;
(3) clearing area around and in said injector hole and in said separated area adjacent said injector hole of debris for injection of an adhesive for flow into said separated area;
(4) then injecting an adhesive into said injector hole to flow into said separated area;
(5) monitoring adhesive flow from said injector hole into said separated area to determine the radial advance of said adhesive from said injector hole to obtain a filling action;
(6) sensing to determine when said injecting of said adhesive under said tiles is exerting too great a force upwardly against said tiles which causes said tiles to be raised above a desired level;
(7) stopping injection of said adhesive when upward tile movement from step (6) is sensed;
(8) placing a weight on a raised tile to maintain a level floor; and
(9) allowing said adhesive to set.

2. A method for repairing a grouted tile floor, wherein tiles were fixed by a layer of adhesive to a base flooring, where a section of said tiles and grouting have become separated from a base flooring forming a separated area therebetween including the steps of:

(1) determining said area of said separated tiles;
(2) drilling a hole through said tiles into said separated area;
(3) clearing said hole and adjacent separated area for injection of an adhesive for flow into said separated area;
(4) then injecting adhesive under pressure into said hole and separated area;
(5) sensing to determine when the injecting of said adhesive under said tiles is exerting too great a force upwardly against said tiles which causes said tiles to be raised above a desired level;
(6) monitoring the radial flow of said adhesive into said separated area under said tiles by sound to determine if the advancing flow is irregular;
(7) stopping injection of said adhesive when upward tile movement from step (5) is sensed, or when a desired separated area has been filled;
(8) forcing said tiles downwardly after step (7) to determine back flow to indicate raised tiles;
(9) placing weights on tiles not level on said base flooring; and

(10) allowing said adhesive to set.

3. A method for repairing a portion of a grouted tile floor where tiles have become separated from a base flooring:

(1) determining a separated area of said tiles;

(2) drilling an injector hole on a grouted joint between said tiles of said separated area into said base flooring;

(3) clearing area around and in said injector hole and in said separated area adjacent said injector hole of debris for injection of an adhesive for flow into said separated area including hitting said tiles around said injector hole to loosen debris in said separated area and to force debris out of said separated area, and removing debris remaining in said injector hole;

(4) then injecting an adhesive into said injector hole to flow into said separated area;

(5) monitoring adhesive flow from said injector hole into said separated area to determine the radial advance of said adhesive from said injector hole to obtain a filling action;

(6) sensing to determine when the injecting of said adhesive under said tiles is exerting too great a force upwardly against said tiles which causes said tiles to be raised above a desired level;

(7) stopping injection of said adhesive when upward tile movement is sensed;

(8) placing weight on a raised tile to maintain a level floor; and (9) allowing said adhesive to set.

4. A method for repairing a portion of a grouted tile floor where tiles have become separated from a base flooring:

(1) determining a separated area of said tiles;

(2) drilling an injector hole on a grouted joint between said tiles of said separated area into said base flooring;

(3) clearing area around and in said injector hole and in said separated area adjacent said injector hole of debris for injection of an adhesive for flow into said separated area;

(4) then injecting an adhesive into said injector hole to flow into said separated area;

(5) monitoring adhesive flow from said injector hole into said separated area to determine the radial advance of said adhesive from said injector hole to obtain a filling action;

(6) sensing to determine when the injecting of said adhesive under said tiles is exerting too great a force upwardly against said tiles which causes said tiles to be raised above a desired level;

(7) stopping injection of said adhesive when upward tile movement from step (6) is sensed;

(8) placing a weight on raised tiles after step (7) to force a back flow of said adhesive through said injector hole to obtain proper level of said raised tiles;

(9) cleaning said back flow of said adhesive from said tiles;

(10) allowing said adhesive to set.

5. A method for repairing a portion of a grouted tile floor where tiles have become separated from a base flooring:

(1) determining a separated area of said tiles;

(2) drilling an injector hole on a grouted joint between said tiles of said separated area into said base flooring;

(3) clearing area around and in said injector hole and in said separated area adjacent said injector hole of debris for injection of an adhesive for flow into said separated area including hitting said tiles around said injector hole to loosen debris in said separated area and to force debris out of said separated area, and removing debris remaining in said injector hole;

(4) then injecting an adhesive into said injector hole to flow into said separated area;

(5) monitoring adhesive flow from said injector hole into said separated area to determine the radial advance of said adhesive from said injector hole to obtain a filling action;

(6) sensing to determine when the injecting of said adhesive under said tiles is exerting too great a force upwardly against said tiles which causes said tiles to be raised above a desired level;

(7) stopping injection of said adhesive when upward tile movement from step (6) is sensed;

(8) placing a weight on raised tiles after step (7) to force a back flow of said adhesive through said injector hole to reduce force against said raised tiles and obtain proper level of said raised tiles;

(9) cleaning said back flow of said adhesive from said tiles;

(10) allowing said adhesive to set.

6. A method for repairing a grouted tile floor, wherein tiles were fixed by a layer of adhesive to a base flooring, where a section of said tiles and grouting have become separated from a base flooring forming a separated area therebetween including the steps of:

(1) determining said area of said separated tiles;

(2) drilling a hole through said tiles into said separated area;

(3) clearing said hole and adjacent separated area for injection of an adhesive for flow into said separated area;

(4) then injecting adhesive under pressure into said hole and separated area;

(5) sensing to determine when the injecting of said adhesive under said tiles is exerting too great a force upwardly against said tiles which causes said tiles to be raised above a desired level;

(6) monitoring the radial flow of said adhesive into said separated area under said tiles by sound to determine if the advancing flow is irregular;

(7) stopping injection of said adhesive when upward tile movement from step (5) is sensed, or when a desired separated area has been filled;

(8) placing a weight on tiles after step (7) which have been moved upwardly to force a back flow of said adhesive through said drilled hole to reduce force against said raised tiles and obtain proper level of said raised tiles;

(9) cleaning said back flow of said adhesive from said tiles;

(10) allowing said adhesive to set.

7. A method for repairing a grouted tile floor, wherein tiles were fixed by a layer of adhesive to a base flooring, where a floor section of said tiles and grouting have become separated from a base flooring forming a separated area therebetween including the steps of:

(1) determining the area of the floor section of separated tiles;

(2) drilling a hole through said floor section of separated tiles into said separated area between said floor section of separated tiles and said base flooring;

(3) clearing said hole and adjacent separated area for injection of an adhesive for flow into said separated area;

(4) then injecting adhesive under pressure into said hole and separated area;

(5) monitoring adhesive flow from said injector hole into said separated area to determine the radial advance of said adhesive from said injector hole to obtain a filling action;

(6) sensing to determine when the injecting of said adhesive under said tiles is exerting too great a force upwardly against said tiles which causes said tiles to be raised above a desired level;

(7) stopping injection of said adhesive of step (4) when raised tile movement from step (6) is sensed;

(8) placing weight on said raised tiles after step (7) to force a back flow of said adhesive through said hole to obtain proper level of said raised tiles;

(9) cleaning said back flow of said adhesive from said tiles;

(10) allowing said adhesive to set.

8. A method as set forth in claim 7 including in step (3) hitting said tiles around said hole to loosen debris in said separated area and to blow out debris out of said separated area into said hole and removing debris remaining in said hole.

* * * * *